United States Patent [19]

Sainen

[11] Patent Number: 4,712,588

[45] Date of Patent: Dec. 15, 1987

[54] PICK SPACING CONTROLLING DEVICE AND METHOD

[75] Inventor: Tsutomu Sainen, Kanazawa, Japan

[73] Assignee: Tsudakoma Corp., Ishikawa, Japan

[21] Appl. No.: 906,261

[22] Filed: Sep. 11, 1986

[30] Foreign Application Priority Data

Sep. 11, 1985 [JP] Japan ..... 60-199539

[51] Int. Cl.[4] ..... D03D 49/20

[52] U.S. Cl. ..... 139/309; 139/97

[58] Field of Search ..... 139/97, 99, 103, 109, 139/110, 304, 307, 308, 309, 310, 311; 66/209, 210, 132, 149

[56] References Cited

U.S. PATENT DOCUMENTS

| | | | |
|---|---|---|---|
| 4,430,870 | 2/1984 | Winter et al. | 66/210 |
| 4,605,044 | 8/1986 | Sakamo | 139/304 |
| 4,619,294 | 10/1986 | Sainen et al. | 139/311 |
| 4,628,967 | 12/1986 | Osterle et al. | 139/304 |

*Primary Examiner*—Henry S. Jaudon

*Attorney, Agent, or Firm*—Flynn, Thiel, Boutell & Tanis

[57] ABSTRACT

A pick spacing controlling device of the digital system for controlling the pick spacing of a fabric being woven on a loom having a main motor for driving the principal weaving mechanism of the loom, and a take-up motor for driving the take-up roller of the loom by controlling the output rotation amount of the take-up motor so that the output rotation amount of the take-up motor varies in direct proportion to that of the main motor or that of the principal part of the loom. The output rotation amount of the take-up motor and that of the main motor or the rotation amount of the principal part of the loom are detected by encoders. An arithmetic unit processes pulse-number modulated input signals corresponding to the output pulse signals of the encoders to obtain the difference between the pulse-number modulated input signals in the number of pulses, and then a driving actuator drives the take-up motor so that the difference is reduced to zero.

4 Claims, 3 Drawing Figures

PICK SPACING CONTROLLING DEVICE AND METHOD

FIELD OF THE INVENTION

The present invention relates to a take-up motion for looms and, more particularly, to a pick spacing controlling device which adjusts the pick spacing by controlling the take-up speed.

BACKGROUND OF THE INVENTION

In a weaving operation, weft yarns are picked successively across the warp and are beaten up into the fabric being woven. The pick spacing is dependent on both picking rate, namely, the number of picks per unit time, and take-up speed, namely, the length of the fabric taken up per unit time. That is, the pick spacing varies in direct proportion to picking rate and in inverse proportion to take-up speed.

According to a prior art disclosed in Japanese Patent Publication No. 44-28270, a loom is provided with a take-up motor in addition to a main motor, and the output rotating speed of the take-up motor is controlled on the basis of the difference between the main motor and the take-up motor in output rotating speed so that the output rotating speed of the take-up motor is directly proportional to that of the main motor, in which the proportional constant is variable according to a predetermined program. However, this prior art, basically, is a speed controlling system which employs a tachometer generator to acquire rotating speed signals, and hence the prior art has the following disadvantages.

(1) A weaving bar results from the difference between the main motor and the take-up motor in the first and last transitions of output rotating speed in the inching operation and at the start-up of the loom.

(2) a large difference in characteristics between the tachometer generators causes pick spacing variation between looms.

(3) The operating characteristics of the same loom vary with time due to the time-variation of the tachometer generator in characteristics, and thereby the pick spacing regulating mode of the loom is changed.

(4) The drift of the control characteristics of the speed control system of the analog type due to the variation of temperature or voltage causes the complex variation of pick spacing.

SUMMARY OF THE INVENTION

Accordingly, it is an object of the present invention to provide a pick spacing controlling device eliminated of the factors of the unstable operation of the foregoing prior art, capable of operating in exact synchronism with the rotation of the crankshaft of the loom, and permitting simple external operation for changing pick spacing.

According to the present invention, a digital positioning control technique is incorporated into a take-up motion control system to detect the rotational amount per unit time of the principal part of the loom and the take-up mechanism digitally and to control the rotational amount per unit time of the take-up motor so that the take-up roller rotates in synchronism with the motion of the principal part of the loom. Since the digital control system detects the rotational amount on the basis of the number of pulses per unit time in a pulse train, the digital control system is capable of achieving satisfactory follow-up control operation at a high accuracy.

Accordingly, the present invention has the following advantages.

The accurate correspondence of the output rotational displacement of the take-up motor to the that of the principal part of the loom prevents filling marks even during the transient weaving operation of the loom.

The digital control system eliminates the variation of control mode between looms and facilitates the pick spacing control procedure.

The digital control system is capable of stable control operation owing to its inherent immunity to secular change and its stability against drift attributable to the external conditions such as voltage variation and temperature variation.

The setting and alteration of pick spacing can be readily achieved through an electrical procedure, and hence the variable control of weaving operation, in which pick spacing is varied discretionarily, for weaving fancy fabrics can be easily achieved.

The digital pick spacing setting operation facilitates the incorporation of computers and/or a central control system into the pick spacing controlling device, enables, when requested, the automatic setting of a pick spacing on the basis of the data of pick spacing previously stored in a memory, facilitates the pick spacing setting operation, avoids erroneous setting of pick spacing, and enables the centralized control of a group of looms.

The above and other objects, features and advantages of the present invention will become more apparent from the following description of the preferred embodiments thereof taken in conjunction with the accompanying drawings.

BRIEF DESCRIPTION OF THE DRAWINGS

FIG. 2 is a block diagram of assistance in explaining the respective coefficients of the components of the pick spacing controlling device of. FIG. 1.

DESCRIPTION OF THE PREFERRED EMBODIMENTS

Figure 1:
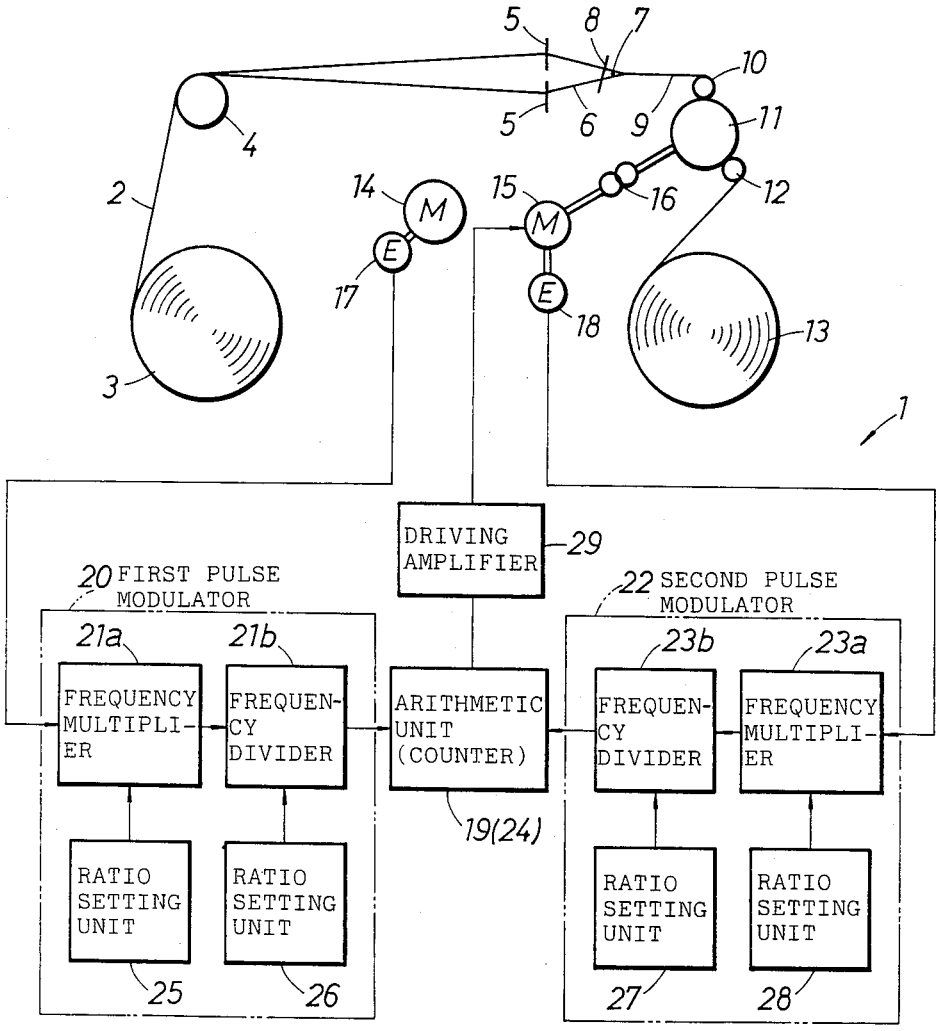
FIG. 1 is a block diagram of a pick spacing controlling device, in a preferred embodiment, according to the present invention.

FIG. 1 illustrates a pick spacing controlling device 1 according to the present invention in relation to the principal mechanisms of a loom.

A plurality of warp yarns 2 are let off from a warp beam 3 in a warp having a width corresponding to the weaving width via a tension roller 4. A shed 6 is formed by the shedding motion of heddles 5. A weft yarn 7 is picked into the shed 6 across the warp, and then the picked weft yarn 7 is beaten with reeds 8 into the fabric. The fabric 9 thus woven is taken up on a take-up beam 13 via a breast roller 10, a take-up roller 11 and a guide roller 12.

The shedding motion of the heddles 5 and the beating motion of the reeds 8 are powered by the main motor 14 of the loom. The take-up roller 11 is driven through a suitable gear train 16 by a take-up motor 15. The warp beam 3 is driven for let-off motion by an individual motor or the main motor 14.

The pick spacing controlling device 1 according to the present invention comprises a first rotational amount detector, namely, an encoder 17, for detecting the rotation of the principal part of the loom such as the output rotational amount of the main motor 14, a second rotational amount detector, namely, an encoder 18, directly connected, for example, to the output shaft of the take-up motor 15, to detect the take-up rotation amount and an arithmetic unit 19 connected to the encoders 17 and 18 to control the rotation of the take-up motor 15.

The encoder 17 is connected through the frequency multiplier 21*a* and the frequency divider 21*b* of a first pulse modulator 20 to one of the two input terminals of the up-down differential counter 24 of the arithmetic unit 19, while the encoder 18 is connected through the frequency multiplier 23*a* and the frequency divider 23*b* of a second pulse modulator 22 to the other input terminal of the differential counter 24. The respective frequency multiplying ratios of the frequency multipliers 21*a* and 23*a*, and the respective frequency dividing ratios of the frequency dividers 21*b* and 23*b* are set by means of ratio setting units 25 and 28, and ratio setting units 26 and 27, respectively. The output terminal of the differential counter 24 is connected through a driving amplifier 29 to the take-up motor 15.

During the weaving operation, the main motor 14 drives the principal mechanisms of the loom, namely, the heddles 5 and the reeds 8 for shedding motion and beating motion, respectively. The output rotational amount of the main motor 14 is detected by the encoder 17. A first pulse signal corresponding to the output rotational amount of the main motor 14 provided by the encoder 17 is given, as an up-input signal, through the frequency multiplier 21*a* and the frequency divider 21*b* to the up-input terminal of the differential counter 24.

On the other hand, the take-up motor 15 is controlled by the arithmetic unit 19 to rotate the take-up roller 11 for taking up the fabric. The output rotating speed of the take-up motor 15 corresponding to the amount of take up is detected digitally by the encoder 18 to obtain a feed-back signal. A second pulse signal corresponding to the output rotational amount of the take-up motor 15 provided by the encoder 18 is given, as a down-input signal, through the frequency multiplier 23*a* and the frequency divider 23*b* to the down-input terminal of the differential counter 24. Upon the reception of the first pulse signal corresponding to the output rotational amount of the main motor 14, the differential counter 24 gives a corresponding signal to the driving amplifier 29 to rotate the take-up motor 15. Upon the reception of the second pulse signal, the differential counter 24 controls the take-up motor 15 so that the difference between the first pulse signal and the second pulse signal in the number of pulses is reduced to zero.

Since the pick spacing controlling device is a digital system which detects the actual condition of the operating parts digitally, processes the detection signals digitally and controls the controlled variables digitally, the pick spacing controlling device is capable of achieving more accurate follow-up control operation as compared with the conventional analog speed control system. Accordingly, the control elements of the pick spacing controlling device of the present invention are immune to the first and last transition characteristics and drift of the main motor 14 and the take-up motor 15, and hence stable pick spacing control operation is achieved.

The frequency multipliers 21*a* and 23*a* and the frequency dividers 21*b* and 23*b* modulate the pulse signals of the encoders 17 and 18 for pulse number modulation on the basis of frequency multiplying ratios and frequency dividing ratios, respectively, to set a pick spacing of the fabric 9.

Figure 2:
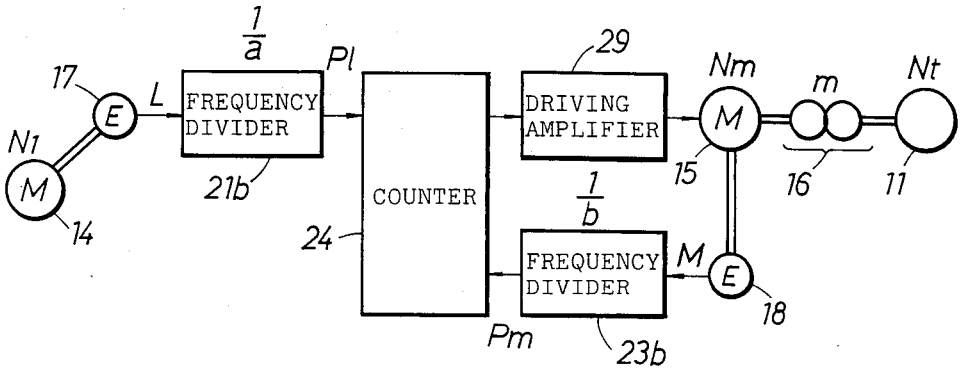

A pick spacing setting procedure will be described hereinafter with reference to FIG. 2. The circumferential speed v mm/sec of the take-up roller 11 is expressed by $$v = 2\pi \cdot \frac{Nt}{60} \cdot \frac{D}{2} = \frac{\pi}{60} \cdot Nt \cdot D \qquad 1$$

where Nt (rpm) is the rotating speed of the take-up roller 11, and D (mm) is the diameter of the take-up roller 11.

On the other hand, a time T sec required for one picking cycle is expressed by $$T = \frac{60}{Nl}$$

where Nl is the rotating speed of the crankshaft of the loom.

Therefore, the pick spacing B (picks/in.) is expressed by $$B = \frac{25.4}{v \cdot T} = \frac{25.4}{(\pi/60) \cdot Nt \cdot D \cdot (60/Nl)} \qquad 2$$

$$= \frac{25.4}{\pi \cdot D} \cdot \frac{Nl}{Nt}$$

The relation of the number Pl of pulses given in one picking cycle by the circuit including the encoder 17 to the differential counter 24 to the resolution L of the encoder 17 and the frequency dividing ratio a is expressed by $$Pl = \frac{L}{a}$$

while the relation of the number Pm of pulses given in one picking cycle by the circuit including the encoder 18 to the differential counter 24 to the output rotating speed Nm (rpm) of the take-up motor 15, the resolution M of the encoder 18, the frequency dividing ratio b, and the rotating speed Nl of the crankshaft is expressed by $$Pm = \frac{Nm}{60} \cdot \frac{M}{b} \cdot \frac{60}{Nl} = \frac{Nm}{Nl} \cdot \frac{M}{b}$$

The differential counter 24 controls the take-up motor 15 so that Pm coincides with Pl. Therefore $$\frac{L}{a} = \frac{Nm}{Nl} \cdot \frac{M}{b} \qquad 3$$

When the gear ratio of the gear train 16 is m, $Nt = Nm/m$. Therefore, $$B = \frac{25.4\ \mathrm{m}}{\pi D} \cdot \frac{Nl}{Nm} = \frac{25.4\ \mathrm{m}}{\pi D} \cdot \frac{M}{L} \cdot \frac{a}{b} \qquad 4$$

Since m, D, M and L in Expression (4) are the intrinsic values of the loom and the pick spacing controlling device, the pick spacing B is dependent only on the ratio a/b between the frequency dividing ratios regardless of the rotating speed Nl of the crankshaft of the loom.

The ratio a/b between the frequency dividing ratios is in a range defined by an inequality $$\frac{\pi DL}{25.4\ mM} \cdot Bmin \leqq \frac{a}{b} \leqq \frac{\pi DL}{25.4\ mM} \cdot Bmax \quad (5)$$

where Bmin and Bmax are the minimum pick spacing and the maximum pick spacing, respectively, and $$\Delta \frac{a}{b} = \frac{\pi DL}{25.4\ mM} \cdot \Delta B \quad (6)$$

where ΔB is the resolution.

A desired pick spacing B is set by properly choosing the ratios a/b between the dividing ratios so that Inequality (5) and Expression (6) are satisfied.

When it is desired that the frequency dividing ratio a and the pick spacing B are in one-to-one correspondence, the frequency dividing ratio b is a constant represented by $$b = \frac{25.4\ mM}{\pi DL}$$

Embodiment 1

Calculated pick spacings B for frequency dividing ratios a and b when gear ratio m is 2831.8, the diameter D of the take-up roller 11 is 163 mm, the number M of pulses generated by the encoder 18 per one rotation of the output shaft of the take-up motor 14 is 1500, and the number L of pulses generated by the encoder 17 per one rotation of the crankshaft is 5000 is tabulated in Table 1, which, however, shows only some of the calculated result on account of limited space.

TABLE 1

| a b | 1 | 2 | 3 | 4 | 5 | 6 | 7 | 8 | 9 | 10 |
|---|---|---|---|---|---|---|---|---|---|---|
| 1 | 42.1 | 21.1 | | | | | | | | |
| 2 | 84.3 | 42.1 | 28.1 | 21.1 | 16.9 | | | | | |
| 3 | 126.4 | 63.2 | 42.1 | 31.6 | 25.3 | 21.1 | 18.1 | 15.8 | | |
| 4 | 168.6 | 84.3 | 56.2 | 42.1 | 33.7 | 28.1 | 24.1 | 21.1 | 18.7 | 16.9 |
| 5 | | 105.3 | 70.2 | 52.7 | 42.1 | 35.1 | 30.1 | 26.3 | 23.4 | 21.1 |
| 6 | | 126.4 | 84.3 | 63.2 | 50.6 | 42.1 | 36.1 | 31.6 | 28.1 | 25.3 |
| 7 | | 147.5 | 98.3 | 73.7 | 59.0 | 49.2 | 42.1 | 36.9 | 32.8 | 29.5 |
| 8 | | 168.6 | 112.4 | 84.3 | 67.4 | 56.2 | 48.2 | 42.1 | 37.5 | 33.7 |
| 9 | | 189.6 | 126.4 | 94.8 | 75.8 | 63.2 | 54.2 | 47.4 | 42.1 | 37.9 |
| 10 | | | 140.5 | 105.3 | 84.3 | 70.2 | 60.2 | 52.7 | 46.8 | 42.1 |

Embodiment 2

Calculated pick spacings B for frequency dividing ratios a and b when gear ratio m is 2831.8, the diameter D of the take-up roller 11 is 163 mm, the number M of pulses generated by the encoder 18 per one rotation of the output shaft of the take-up motor 14 is 1500, the number L of pulses generated by the encoder 17 per one rotation of the crank shaft is 2000, the frequency multiplying ratio is 4, and the frequency dividing ratio b is 26 (constant), and those when L is 2500, the frequency multiplying ratio is 4 and the frequency dividing ratio b is 21 (constant) are tabulated in Table 2, which, however, shows only some of the calculated result on account of limited space.

TABLE 2

| a | b = 26 | b = 21 |
|---|---|---|
| 15 | 15.2 | 15.0 |
| 16 | 16.2 | 16.1 |
| 17 | 17.2 | 17.1 |

TABLE 2-continued

| a | b = 26 | b = 21 |
|---|---|---|
| 18 | 18.2 | 18.1 |
| 19 | 19.2 | 19.1 |
| 20 | 20.3 | 20.1 |
| 21 | 21.3 | 21.1 |
| 22 | 22.3 | 22.1 |
| 23 | 23.3 | 23.1 |
| 24 | 24.3 | 24.1 |
| 25 | 25.3 | 25.1 |
| 26 | 26.3 | 26.1 |
| 27 | 27.4 | 27.1 |
| 28 | 28.4 | 28.1 |
| 29 | 29.4 | 29.1 |
| 30 | 30.4 | 30.1 |
| 31 | 31.4 | 31.1 |
| 32 | 32.4 | 32.1 |
| 33 | 33.4 | 33.1 |
| 34 | 34.4 | 34.1 |
| 35 | 35.5 | 35.1 |
| 36 | 36.5 | 36.1 |
| 37 | 37.5 | 37.1 |
| 38 | 38.5 | 38.1 |
| 39 | 39.5 | 39.1 |
| 40 | 40.5 | 40.1 |
| 41 | 41.5 | 41.1 |
| 42 | 42.5 | 42.1 |
| 43 | 43.6 | 43.1 |
| 44 | 44.6 | 44.1 |
| 45 | 45.6 | 45.1 |
| 46 | 46.6 | 46.2 |
| 47 | 47.6 | 47.2 |
| 48 | 48.6 | 48.2 |
| 49 | 49.6 | 49.2 |
| 50 | 50.6 | 50.2 |

The pick spacing controlling device described above is a digital servomechanism of the closed loop system, however, the same may be a pulse motor servomechanism of the open loop system.

Figure 3:
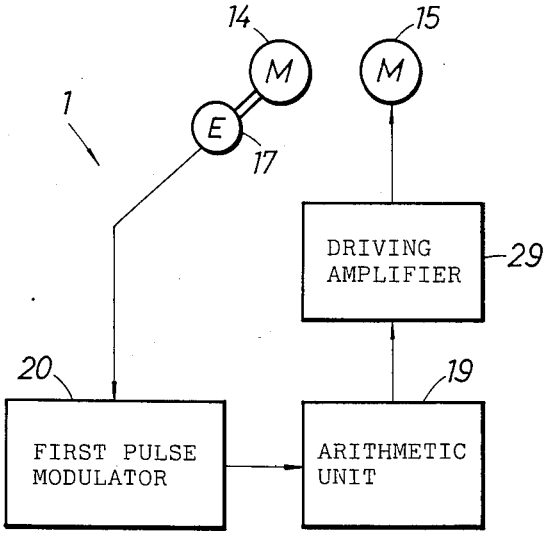
FIG. 3 is a block diagram of a pick spacing controlling device, in another embodiment, according to the present invention.

FIG. 3 illustrates a pick spacing controlling device of the open loop system. A first 20 modulator modulates an input signal into a pulse signal having an appropriate number of pulses and gives the pulse signal to an arithmetic unit 19. The arithmetic unit 19 generates pulses corresponding to the input pulse signal and gives the pulses to a driving amplifier 29 to drive a take-up pulse motor 15. The driving amplifier 29 controls the excitation of the take-up pulse motor 15 for stepping rotation in proportion to the output rotational amount of a main motor 14. Thus, the pulse motor servomechanism need not be provided with the encoder 18 for the feedback of the controlled variable and the second pulse modulator.

In the embodiment described hereinbefore, the frequency multiplying ratios of the frequency multipliers **21*a* and 23*a*, and the frequency dividing ratios of the frequency dividers 21*b* and 23*b* are set by the separate ratio setting elements 25 and 27, and 26 and 28**, however, these ratio setting elements may be substituted by a host computer for centralized control. Accordingly, the pick spacing controlling device according to the present invention can be readily incorporated into a digital control system such as a microcomputer or a host computer.

Although the invention has been described in its preferred form with a certain degree of particularity, it it to be understood that many variations and changes are possible in the invention without departing from the scope and spirit thereof.

What is claimed is:

1. A pick spacing controlling device for controlling the pick spacing of a fabric being woven on a loom having a main motor for driving a principal weaving mechanism of the loom and having a take-up motor for driving a take-up roller for the fabric by controlling the take-up motor so that the amount of rotation of the take-up motor during a given time interval is directly proportional to that of the main motor, comprising:

a first rotation amount detector which provides a first number of digital pulses proportional to the amount of rotation of the main motor during said given time interval;

a second rotation amount detector which provides a second number of digital pulses proportional to the amount of rotation of the take-up roller during said given time interval;

a first pulse number modulator which digitally modulates the first number of pulses from the first rotation amount detector by a predetermined ratio;

a second pulse number modulator which digitally modulates the second number of pulses from the second rotation amount detector by a predetermined ratio;

an arithmetic unit which digitally calculates the difference between the number of pulses output by the first pulse number modulator and the number of pulses output by the second pulse number modulator during said given time interval; and a driving amplifier which is responsive to the arithmetic unit and controls the amount of rotation of the take-up motor so as to reduce said difference toward zero.

2. A pick spacing controlling device as recited in claim 1, wherein said arithmetic unit includes an up-down differential counter.

3. A pick spacing controlling device as recited in claim 1, wherein said first pulse number modulator and said second pulse number modulator each include a respective frequency divider.

4. A pick spacing controlling device as recited in claim 1, wherein said first pulse number modulator and said second pulse number modulator each include a respective frequency multiplier.

* * * * *